US009138769B2

(12) United States Patent
Riley

(10) Patent No.: US 9,138,769 B2
(45) Date of Patent: Sep. 22, 2015

(54) HAND-HOLDABLE PAINTING APPARATUS

(71) Applicant: BLACK & DECKER INC., Newark, DE (US)

(72) Inventor: Martyn Riley, Newcastle upon Tyne (GB)

(73) Assignee: BLACK & DECKER INC., Newark, DE (US)

( * ) Notice: Subject to any disclaimer, the term of this patent is extended or adjusted under 35 U.S.C. 154(b) by 291 days.

(21) Appl. No.: 13/930,182

(22) Filed: Jun. 28, 2013

(65) Prior Publication Data

US 2014/0010581 A1 Jan. 9, 2014

(30) Foreign Application Priority Data

Jul. 9, 2012 (EP) ..... 12175595

(51) Int. Cl.
*B05C 1/00* (2006.01)
*B05C 17/005* (2006.01)
*B05C 17/01* (2006.01)

(52) U.S. Cl.
CPC ..... *B05C 1/00* (2013.01); *B05C 17/00506* (2013.01); *B05C 17/0103* (2013.01)

(58) Field of Classification Search
CPC ..... B05C 1/06
USPC ..... 401/140, 143, 207, 261, 263, 265, 266
See application file for complete search history.

(56) References Cited

U.S. PATENT DOCUMENTS

| | | | | | |
|---|---|---|---|---|---|
| 2,459,296 | A * | 1/1949 | Smith | 401/180 |
| 2,526,119 | A * | 10/1950 | Cravis | 401/204 |
| 3,820,905 | A * | 6/1974 | Sims | 1/140 |
| 4,250,586 | A * | 2/1981 | Timian | 401/207 |
| 4,611,941 | A * | 9/1986 | Karliner et al. | 401/207 |
| 4,639,156 | A * | 1/1987 | Stern et al. | 401/146 |
| 5,213,432 | A * | 5/1993 | Chappell | 401/273 |
| 5,454,656 | A * | 10/1995 | Rowe | 401/146 |
| 5,496,123 | A * | 3/1996 | Gaither | 401/176 |
| 8,276,538 | B2 | 10/2012 | Ling et al. | |
| 8,529,148 | B2 * | 9/2013 | Hoek et al. | 401/193 |
| 2001/0003563 | A1 * | 6/2001 | Schauer et al. | 401/266 |
| 2007/0110505 | A1 * | 5/2007 | Frank et al. | 401/197 |
| 2008/0223292 | A1 * | 9/2008 | Ling | 118/211 |
| 2012/0134737 | A1 | 5/2012 | Ling et al. | |

* cited by examiner

*Primary Examiner* — David Walczak
*Assistant Examiner* — Bradley Oliver
(74) *Attorney, Agent, or Firm* — Stephen R. Valancius

(57) ABSTRACT

A hand-holdable painting apparatus comprising a main body with a handle, wherein the main body is arranged to removably engage with a paint applicator; and a paint reservoir receiving bay coupled to or integral with the main body, wherein the paint reservoir receiving bay is arranged to removably receive at least a portion of a paint reservoir. The main body is arranged to provide a paint flow path between an outlet of a paint reservoir in the paint reservoir receiving bay and an inlet of a paint applicator engaged with the main body. The hand-holdable painting apparatus further comprises an interlock configured to inhibit the paint reservoir receiving bay from receiving a paint reservoir unless a paint applicator is engaged with the main body.

15 Claims, 8 Drawing Sheets

HAND-HOLDABLE PAINTING APPARATUS

CROSS-REFERENCE TO RELATED APPLICATIONS

This application claims priority to EP Patent Application No. EP 12175595.3 filed Jul. 9, 2012, the contents thereof to be incorporated herein by reference in its entirety.

FIELD OF THE INVENTION

The present invention relates to hand-holdable painting apparatus.

BACKGROUND OF THE INVENTION

A paint brush is a conventional type paint applicator. A paint brush has limited paint carrying capacity. A paint brush can be inconvenient to clean and is often thrown away before the end of its serviceable life even though replacing a paint brush can be costly.

Another conventional type of paint applicator is a paint pad. A paint pad can be relatively inexpensive so that it may be thrown away to save cleaning time even though it can be easier to clean than a paint brush. A paint pad has limited paint carrying capacity.

US patent publication No. 2012/0134737 discloses a hand-holdable painting apparatus. It is used to apply paint to a work surface instead of a paint brush or a paint pad. The hand-holdable painting apparatus is particularly useful for performing a trimming function i.e. applying paint to a work surface in close proximity to another surface, which is either not to be painted or to be painted a different color.

The hand-holdable painting apparatus of US2012/0134737 has a removable paint reservoir which may be refilled or renewed. It also has a removable paint applicator which may be cleaned or renewed, but only once the paint reservoir has been removed so as to limit contact of paint with non-removable parts of the apparatus. A vibration mechanism may alleviate friction between the paint applicator and a work surface and a paint delivery mechanism helps provide smooth discharge of paint from the paint reservoir to the paint applicator. These advantages result from a relatively sophisticated apparatus the function of which may be maintained by avoidance of accumulation of dry paint on and around non-removable parts.

BRIEF SUMMARY OF THE INVENTION

Accordingly, in a first aspect of the present invention, there is provided a hand-holdable painting apparatus comprising: a main body with a handle, wherein the main body is arranged to removably engage with a paint applicator; and a paint reservoir receiving bay coupled to or integral with the main body, wherein the paint reservoir receiving bay is arranged to removably receive at least a portion of a paint reservoir, wherein the main body is arranged to provide a paint flow path between an outlet of a paint reservoir in the paint reservoir receiving bay and an inlet of a paint applicator engaged with the main body, and wherein the hand-holdable painting apparatus comprises: an interlock configured to inhibit the paint reservoir receiving bay from receiving a paint reservoir unless a paint applicator is engaged with the main body. Embodiments of the present invention prevent connection and use of a paint reservoir until ready to be received by the paint receiving bay which only occurs once a paint applicator is engaged with the main body. Advantageously, this ensures that paint reservoir loading is the last step in the assembly sequence of the painting apparatus before use. This is particularly beneficial as typically the paint reservoir is charged with paint before use and premature discharge of paint prior to full assembly of the painting apparatus may be greater. A paint reservoir receiving bay may be coupled to the main body in the sense that it may, for example, be fixed in relation, or connected, to the main body.

Preferably, the interlock is moved to permit the paint reservoir receiving bay to receive a paint reservoir upon engagement of a paint applicator with the main body. The interlock may be moved automatically as a result of engagement between the paint applicator and main body. This may avoid the inconvenience of any additional operations to operate the interlock.

Preferably, the interlock is moved to permit the paint reservoir receiving bay to receive a paint reservoir by contact between the interlock and a paint applicator engaged with the main body. Direct contact between the paint applicator and interlock may permit entry into the paint reservoir receiving bay. This may avoid the need for any additional components inter-linking the interlock and paint applicator.

Preferably, the interlock is biased to inhibit the paint reservoir receiving bay from receiving a paint reservoir. The interlock may be biased by any resilient member, like, for example, a spring or a compressible elastic body. The interlock naturally returns to a position in which it inhibits entry into the paint reservoir receiving bay once a paint applicator is disengaged from the main body. This may avoid the inconvenience of resetting the interlock to its inhibiting position.

Preferably, the main body has a paint applicator receiving cavity arranged to removably receive an inlet portion of a paint applicator engaged with the main body. The paint applicator receiving cavity locates the paint applicator's inlet where it may reliably couple, either directly or indirectly, to the outlet of a paint reservoir in the paint reservoir receiving bay.

Preferably, the paint applicator receiving cavity and the paint reservoir receiving bay are mutually aligned to fluidly couple an outlet of a paint reservoir received in the paint reservoir receiving bay with an inlet of a paint applicator engaged with the main body. The paint reservoir's outlet may deliver paint directly to the paint applicator's inlet without necessarily contacting the main body. As mentioned above, the paint reservoir and paint applicator are removable from the main body to facilitate cleaning, renewal or refilling.

Preferably, the interlock comprises a see-saw member pivotable about an interlock axis fixed in relation to the main body and wherein a first end of the see-saw member inhibits the paint reservoir receiving bay from receiving a paint reservoir unless a second opposite end of the see-saw member is contacted by a paint applicator engaged with the main body. The see-saw member provides a compact and efficient way of transferring movement between two locations in the main housing.

Preferably, the second end of the see-saw member is contactable with an inlet portion of a paint applicator engaged with the main body. Direct contact between the paint applicator and see-saw member may initiate operation of the interlock to permit entry into the paint reservoir receiving bay. This may avoid the need for any additional components interlinking the see-saw and paint applicator.

Preferably, the see-saw member has an L-shaped profile configured to accommodate a portion of a paint reservoir received by the receiving bay paint reservoir. A portion of the paint reservoir may nest in the elbow of the L-shaped profile when the interlock permits entry into the paint reservoir receiving bay. This provides a secure fitting together of the parts, and improves efficient use of space within the main body of the hand-holdable painting apparatus.

Preferably, the painting apparatus comprises a vibration mechanism for vibrating a paint pad of a paint applicator engaged with the main body. Vibration of the paint applicator's paint pad against a work surface may inhibit drag and improve control of the hand-holdable painting apparatus.

Preferably, the painting apparatus comprises a power source to energise the vibration mechanism and a switch operable to couple the power source to the vibration mechanism. The power source may be anything capable of operating the vibration mechanism without input from the user, like, for example, a clock-work mechanism, mains electrical supply, a removable battery pack or battery cells.

Preferably, the painting apparatus comprises a paint flow control mechanism to adjustably control flow of paint from a paint reservoir received in the paint reservoir receiving bay to a paint applicator engaged with the main body. The paint flow control mechanism permits user adjustable control of paint delivery to the paint applicator.

Preferably, the painting apparatus comprises a paint delivery mechanism arranged to cause flow of paint from a paint reservoir received in the paint reservoir receiving bay to a paint applicator engaged with the main body. The paint delivery mechanism may interact with the paint reservoir to substantially uniformly discharge paint from it to the paint applicator. The paint delivery mechanism may comprise, for example, a spring which may be a constant force spring, a pressurised canister, or a spring in the paint reservoir.

Preferably, the painting apparatus comprises a second interlock configured to inhibit disengagement of a paint applicator from the main body while a paint reservoir is received in the paint reservoir receiving bay. This ensures that paint reservoir removal is the first step in the disassembly sequence of the painting apparatus after use. This removes the source of potential paint spillage.

In a second aspect of the present invention, the painting apparatus of the first aspect is equipped with a paint reservoir removably received in the paint reservoir receiving bay and a paint applicator removably engaged with the main body.

BRIEF DESCRIPTION OF THE DRAWINGS

These and other features and advantages of the present invention will be understood from the following detailed description which is given by way of example and with reference to the accompanying drawings, of which.

DETAILED DESCRIPTION OF THE INVENTION

Figure 1:
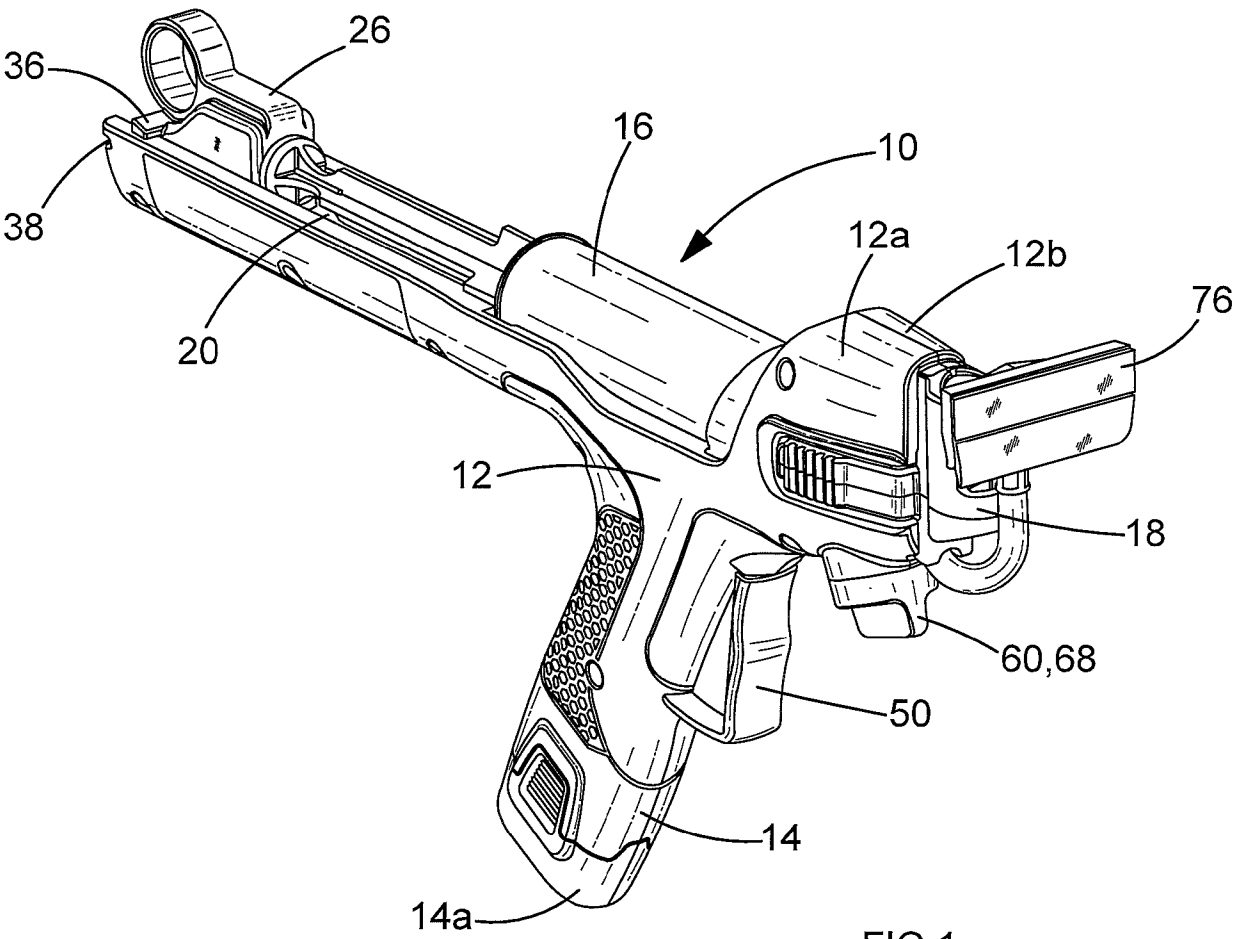
FIG. 1 shows a perspective view of a hand-holdable painting apparatus.
Figure 2:
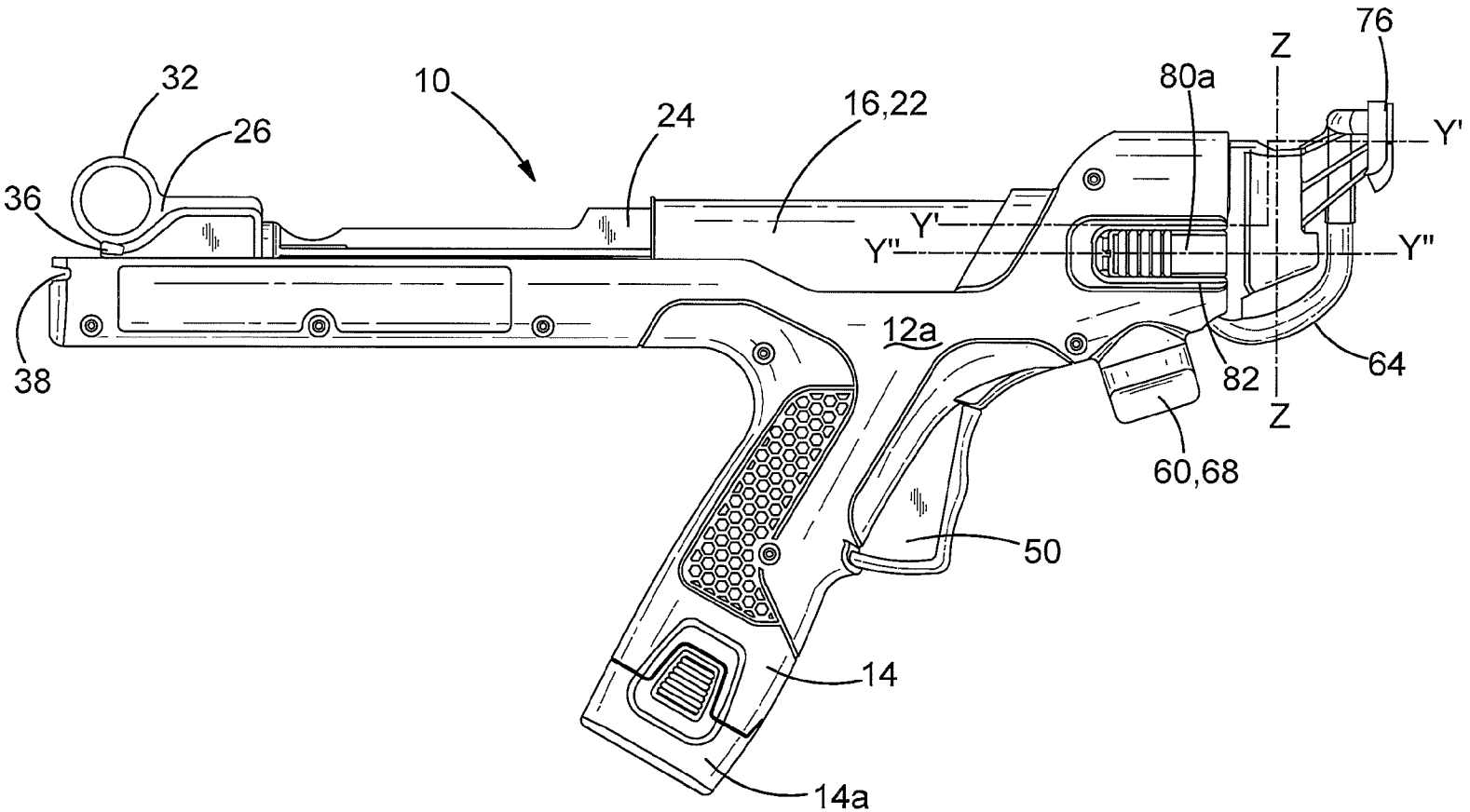
FIG. 2 shows a side elevation view of the painting apparatus of FIG. 1.
Figure 3:
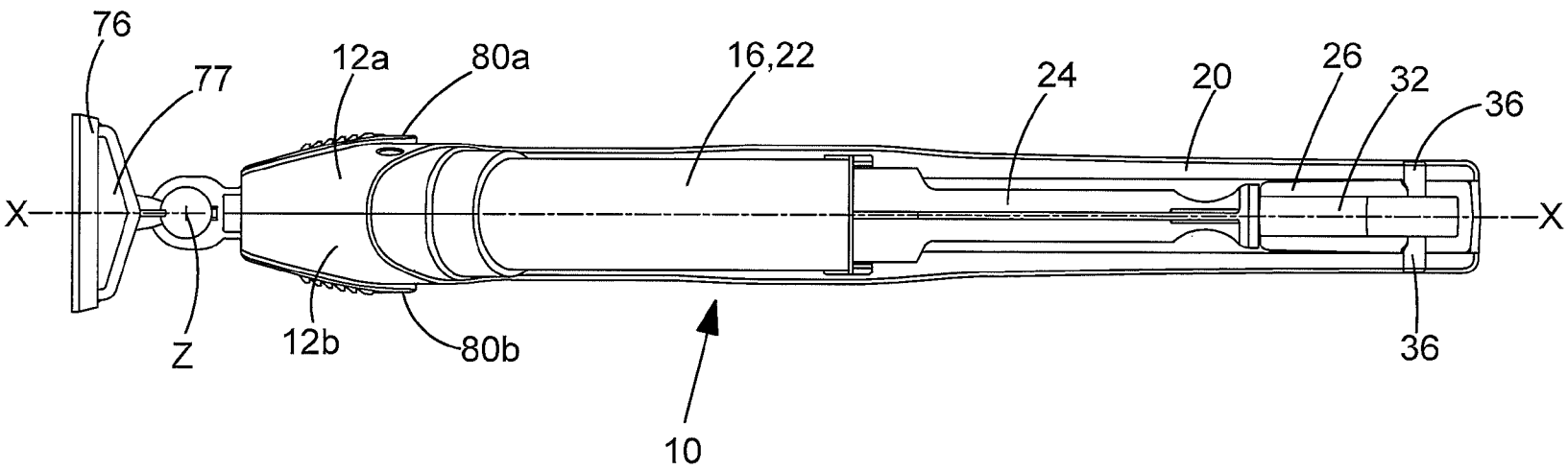
FIG. 3 shows a top view of the painting apparatus of FIG. 1.
Figure 4:
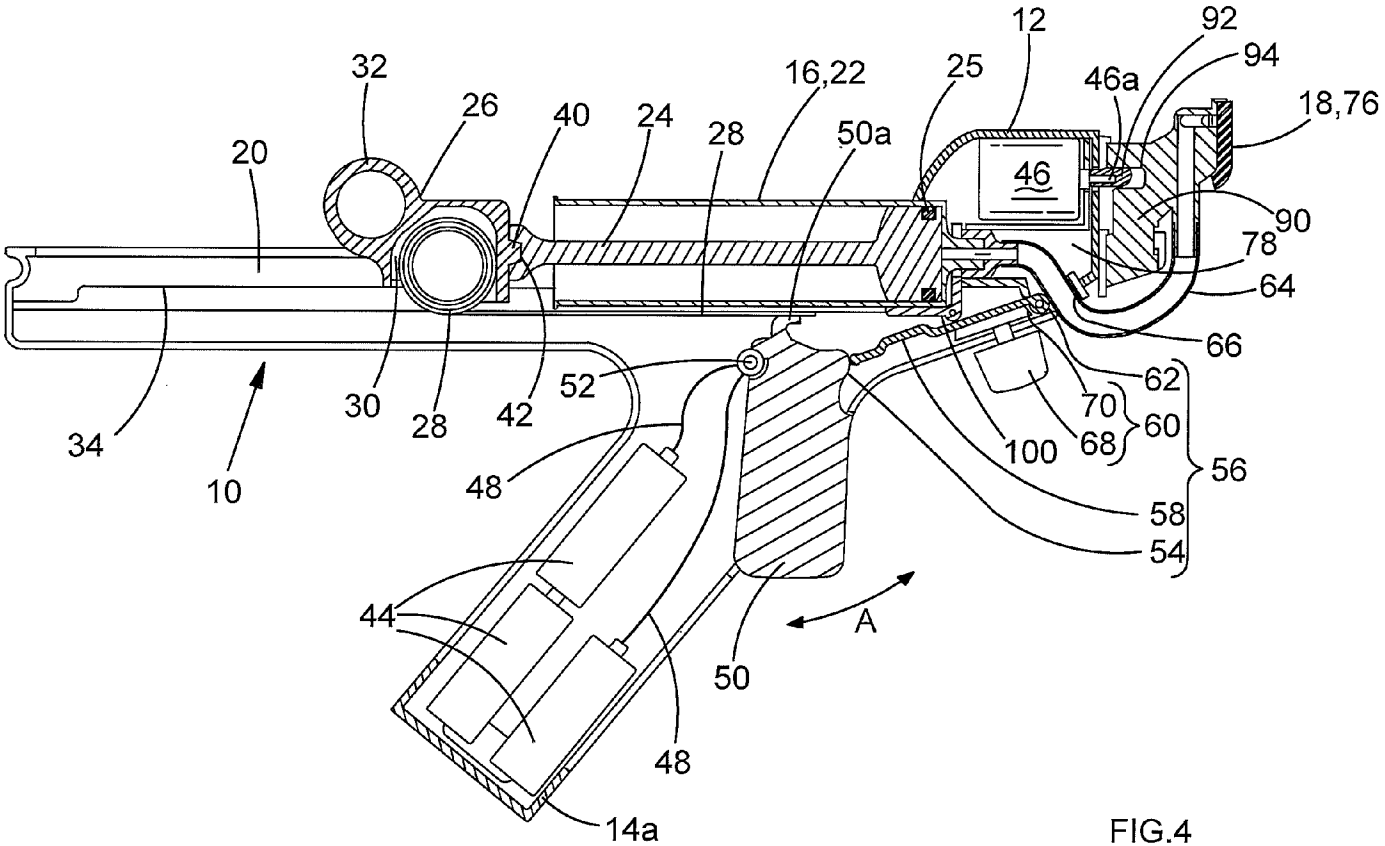
FIG. 4 shows a cross-sectional view of the painting apparatus along plane X-X in FIG. 3.
Figure 5:
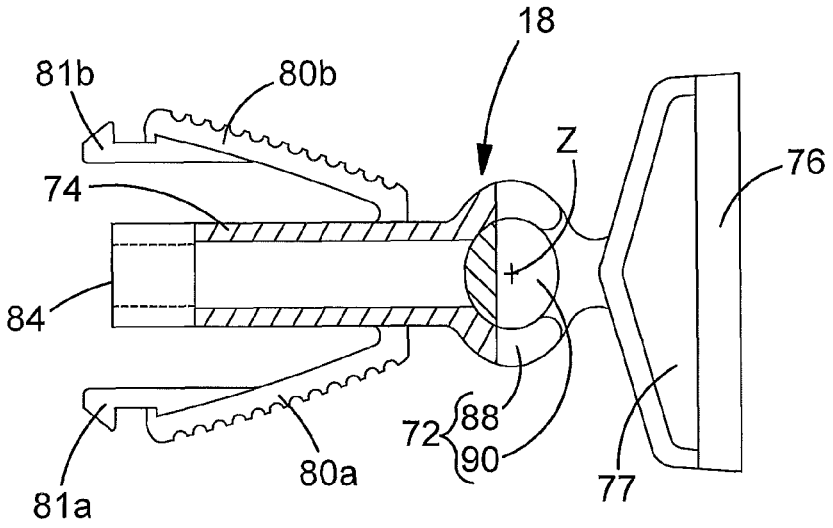
FIG. 5 shows a cross-sectional view of a paint applicator along plane Y'-Y' in FIG. 2.

Referring to FIGS. 1 to 6, there is shown a hand-holdable painting apparatus 10 comprising a main body 12 with a handle 14. The main body is formed of two clam shells 12*a*, 12*b* which are made of rigid material, such as plastics material, and which capture internal parts of the main body during assembly.

The painting apparatus 10 comprises a removable paint reservoir 16 and a removable paint applicator 18. In use, the paint reservoir is located in a paint reservoir receiving bay 20 in the main body 12 and the paint applicator is engaged to the main body, as is explained in more detail below. The painting apparatus and the removable features thereof are configured such that the paint path is disposed within components of the removable paint reservoir 16 and the removable paint applicator 18 such that paint is at least limited, and ideally prevented, from coming into contact with non-removable parts of the painting apparatus such as the main body and its internal parts.

The paint reservoir 16 comprises a syringe 22 with a plunger 24 sealed by an O-ring 25 for paint filling and dispensing. The paint reservoir, after having been located in the paint reservoir receiving bay 20, is engaged by a paint delivery mechanism 26. The paint delivery mechanism is biased to advance the plunger inside the syringe during operation of the painting apparatus 10. The biasing force is provided by a constant force spring 28 at least partially coiled within an enclosure 30 defined by the paint delivery mechanism. A relatively constant paint flow from the paint reservoir to the paint applicator is achieved by the constant force spring.

The paint delivery mechanism 26 comprises a pull handle 32 for pulling rearwardly while locating the paint reservoir 16 in the paint reservoir receiving bay 20. The paint delivery mechanism slides along tracks 34 in sides of the paint reservoir receiving bay while urging the plunger 24 into the syringe 22. Lateral projections 36 from the paint delivery mechanism 26 are provided to temporarily dock the paint delivery mechanism at the rear of the painting apparatus 10 by inserting the projections into c-shaped slots 38 at the rear of the main body 12. The paint delivery mechanism, which is biased forwardly by the constant force spring 28, can thereby be temporarily positioned away from the syringe when the paint reservoir is being located in, or removed from, the paint reservoir receiving bay. The paint delivery mechanism 26 comprises a protrusion 40 to engage with a bore 42 formed on the plunger 24 to stabilize the paint reservoir during use.

The handle 14 portion of the main body 12 houses a power source in the form of battery cells 44 for powering an electric motor 46 also housed within the main body. Wires 48 within the main body electrically connect the power source to the motor. The main body has a removable door 14*a* at the bottom of the handle 14 to facilitate removal of the battery cells.

The handle 14 portion of the main body 12 also houses a trigger 50 pivotally coupled to the main body to pivot in the direction of the double-headed arrow A. The trigger is biased by a spring (not shown) to a release position as is shown in FIGS. 1 to 4. The trigger is configured to perform multiple functions, as is discussed in more detail below.

The trigger 50 is configured, when depressed, to move a switch 52 to establish electric current flow from the battery cells 44, through the wires 48 and to the motor 46. The trigger has a cam surface 54 housed in the main body 12 that forms part of a flow control system 56. The flow control system also includes a pinch bar 58, a flow control mechanism 60 and a cam 62. The cam surface 54 of the trigger and the flow control mechanism 60 are both connected to the pinch bar 58. The pinch bar can slide within the main body forward and backward with respect to the paint applicator 18.

When the trigger 50 is released, the cam surface 54 contacts the pinch bar 58 of the trigger to restrain rearward movement of the pinch bar from its fully forward position. The pinch bar holds the cam 62 against a paint feed tube 64 of the paint applicator which collapses against a surface 66 in the paint applicator. As the trigger 50 is depressed, the pinch bar 58 encounters a change in the profile of the cam surface 54 of the trigger and is allowed to move rearward. The pinch bar 58 and the cam 62 move rearward due to the recovery bias force of the paint feed tube 64. The lumen of the paint feed tube is opened to permit paint flow.

The flow control mechanism 60 of the flow control system 56 has a rotatable control knob 68 coupled to an eccentric cam face 70. Once the trigger 50 has been depressed, rearward movement of the pinch bar 58 is controlled by the position of the eccentric cam face 70. The flow control mechanism 60 dictates how far the lumen of the paint feed tube 64 can be opened by the pinch bar 58. A user can adjust paint flow through the lumen of the paint feed tube to less than the maximum, even when the trigger 50 is fully depressed.

Paint flows generally freely from the paint reservoir 16 to the paint pad 76 under the influence of the paint delivery mechanism 26 unless inhibited by the flow control system 56.

The trigger 50 is configured to provide a momentary jolt to the constant force spring 28 when the painting apparatus 10 is initially used. The constant force spring is initially connected by friction to a toe portion 50*a* of the trigger. When the trigger is depressed the toe moves forward to pull the constant force spring and provoke it into moving from a static non-flow position to a dynamic flow position.

The paint applicator 18 comprises a receiver structure 72, a manifold 74, the paint feed tube 64, and a paint pad 76 removably attached to a paint pad support 77 connected to the receiver structure. The manifold is slidably engaged within a paint applicator receiving cavity 78 in the main body 12 when the receiver structure 72 is connected to the main body. The receiver structure is configured for removable connection to the main body by snap-fit lock between elastically flexible cantilever arms 80*a*, 80*b* on the receiver structure and grooves 82 in the front end of the main body. For connection of the receiver structure to the main body, a hook 81*a*, 81*b* at the end of each cantilever arm engages with a respective rebate (only 83*b* shown in FIG. 7) at the end of each groove and on the inside of the clam shells 12*a*, 12*b*. For removal, the cantilever arms are flexed inwards towards each other to disengage the hooks from the rebates.

The manifold 74 has an inlet port 84 in fluid communication with the paint feed tube 64 which is in fluid communication with the paint pad 76. The inlet port 84 is configured to receive an outlet port 86 of the syringe 22 to fluidly couple of the paint reservoir 16 located in the paint reservoir receiving bay 20 to the paint pad 76. A tight fit between the inlet port and the outlet port prevents paint leakage from the join and provides a keying feature to stabilize the paint reservoir in the paint reservoir receiving bay.

The receiver structure 72 comprises a hollow cylindrical socket portion 88 open along one side and a generally cylindrical coupling portion 90 slidably and pivotably disposed within the socket portion. The paint pad 76 is removably mounted to the paint pad support 77 which protrudes forward from the coupling portion of the receiver structure. The paint pad shown is made of foam, although it may be made from other porous material and/or have bristles.

The motor 46 has an output spindle 46*a* protruding from the main body 12 so as to contact the coupling portion 90 of the paint applicator 18. The output spindle has a drive cam 92 contactable with a cam follower surface 94 in the coupling portion. The motor, the output spindle, the drive cam and the cam follower surface collectively form a vibration mechanism. Depression of the trigger 50 operates the switch 52 to energise the motor 46 and, in doing so, impart vibrating motion to the coupling portion along the central axis Z-Z of the socket portion 88. The central axis Z-Z is substantially coplanar with the plane X-X which divides the two clam shells 12*a*, 12*b* of the main body. Vibrating the paint pad of the paint applicator against the work surface, approximately in line with the direction the user is pulling the painting apparatus, can inhibit drag and increase control of the painting apparatus. Alternative arrangements may allow vibration of the paint pad in other directions relative to the main body, in addition to or instead of such vibration.

To limit the contact of paint with non-disposable parts of the painting apparatus 10, such as the main body 12 and its internal parts, the painting apparatus has been configured to provide a certain sequencing in connecting and disconnecting the paint reservoir 16 and paint applicator 18 as is described in more detail below.

Figure 7:
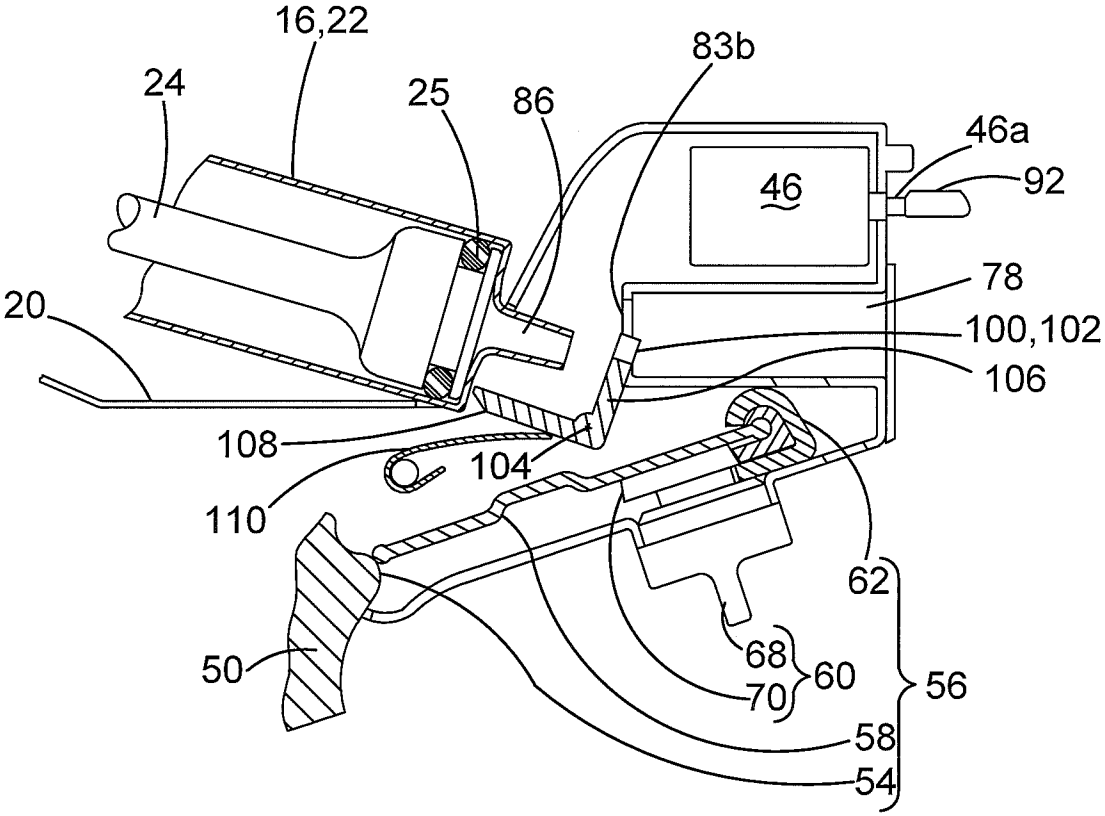
FIG. 7 is a detail view of FIG. 4 showing an interlock member biased by a spring.
Figure 8:
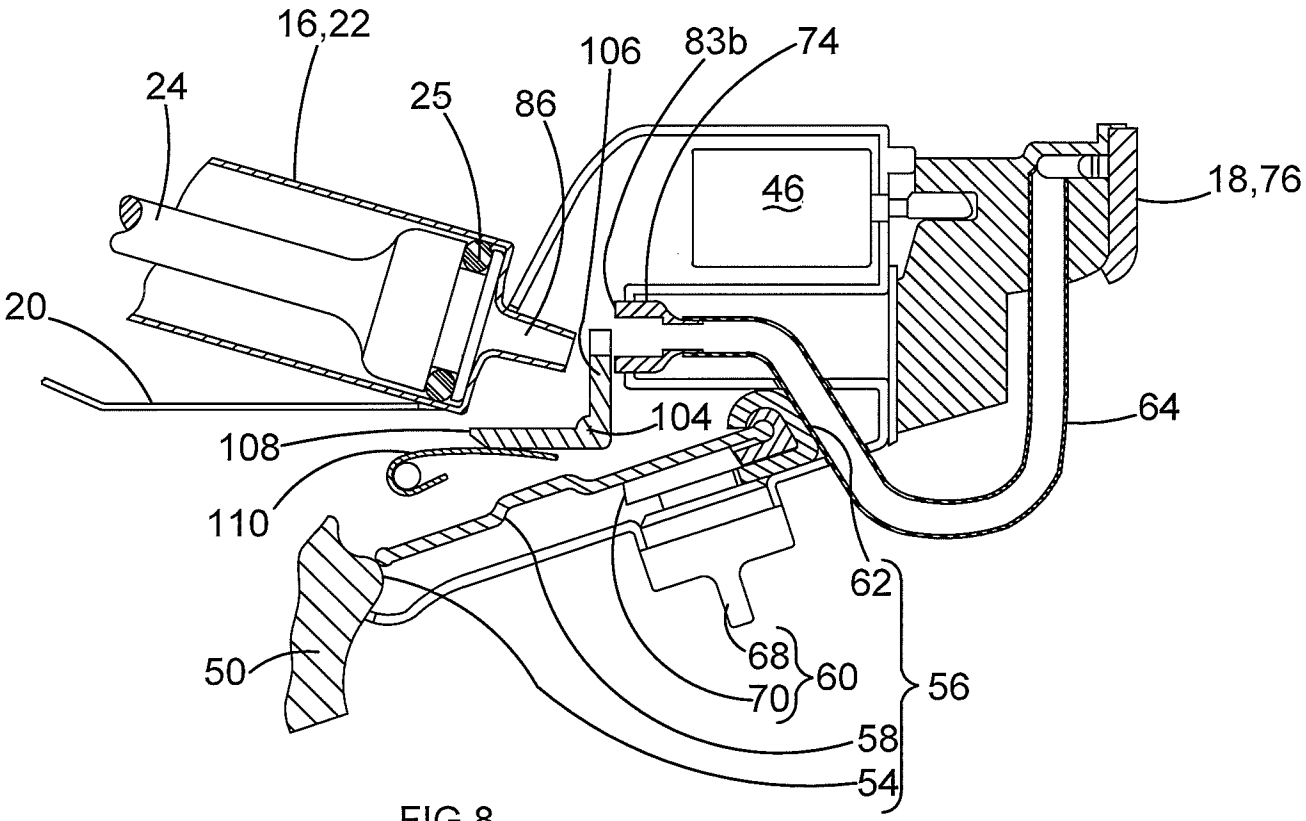
FIG. 8 is a detail view of FIG. 4 showing the interlock member of FIG. 7 contacted by a manifold with an inlet port of the paint applicator.
Figure 9:
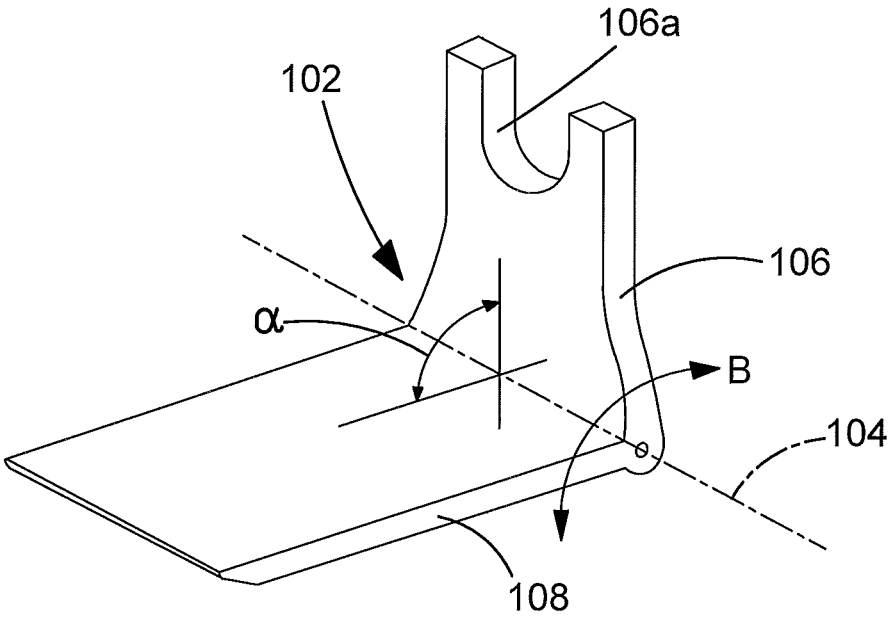
FIG. 9 shows a perspective view of the interlock member of FIG. 7.

Referring to FIGS. 7 to 9, the main body 12 has an interlock 100 which is configured to inhibit the paint reservoir receiving bay 20 from receiving the paint reservoir 16 unless the paint applicator 18 is engaged with the main body. The interlock comprises a see-saw member 102 pivotable in the direction of the double-headed arrow B about an interlock axis 104 fixed in relation to the main body. The see-saw member is made of rigid material such as plastics material or metal. The see-saw member comprises a paint applicator limb 106 joined at the interlock axis to a paint reservoir limb 108. The see-saw member has a generally L-shaped cross-sectional profile in a plane normal to the interlock axis. The two limbs subtend an angle $\alpha$ of approximately 90 degrees in the example shown. However, angle $\alpha$ can be altered during design phase of the painting apparatus 10 to suit the arrangement of the internal parts of the main body 12.

The interlock 100 comprises an interlock spring 110 which biases the see-saw member 102 towards a blocking position shown in FIG. 7 where the paint reservoir limb 108 is inclined to occupy part of the paint reservoir receiving bay 20 and the paint applicator limb 106 is inclined towards part of the paint applicator receiving cavity 78. In the blocking position, the paint reservoir limb inhibits the paint reservoir receiving bay from receiving a paint reservoir. The interlock spring shown is a leaf spring, although it could be another type of spring or other resilient body.

Upon connection of the receiver structure 72 to the main body 12, the manifold 74 enters the paint applicator receiving cavity 78 and contacts the paint applicator limb 106. This pushes the see-saw member 102 against the bias of the interlock spring 110 towards an unblocking position shown in FIG. 8 where the paint reservoir limb 106 is retracted from the paint reservoir receiving bay 20. Only in the unblocking position does the paint reservoir limb permit entry of a paint reservoir 16 into the paint reservoir receiving bay. The inlet port 84 of the manifold 74 is now ready to receive an outlet port 86 of a syringe 22 to fluidly couple of a paint reservoir 16 to the paint applicator's paint pad 76.

For economic use of space within the main body, a front corner of the syringe 22 is seated in the elbow the L-shaped see-saw member 102. Likewise, an end of the paint applicator limb 106 has a curved recess 106*a* which is shaped to fit around the outlet port 86 and between the syringe 22 and the manifold 74 without inhibiting the tight fit between the inlet and outlet ports 84, 86.

The interlock 100 ensures that paint reservoir loading is the last step in the assembly sequence of the painting apparatus 10 before use. This helps to limit or avoid premature discharge of paint by inattention on the part of a user who may have neglected to attach a paint applicator 18 first. This helps to limit or avoid spillage of paint on parts of the main body, especially from a paint reservoir freshly charged with paint.

Figure 6:
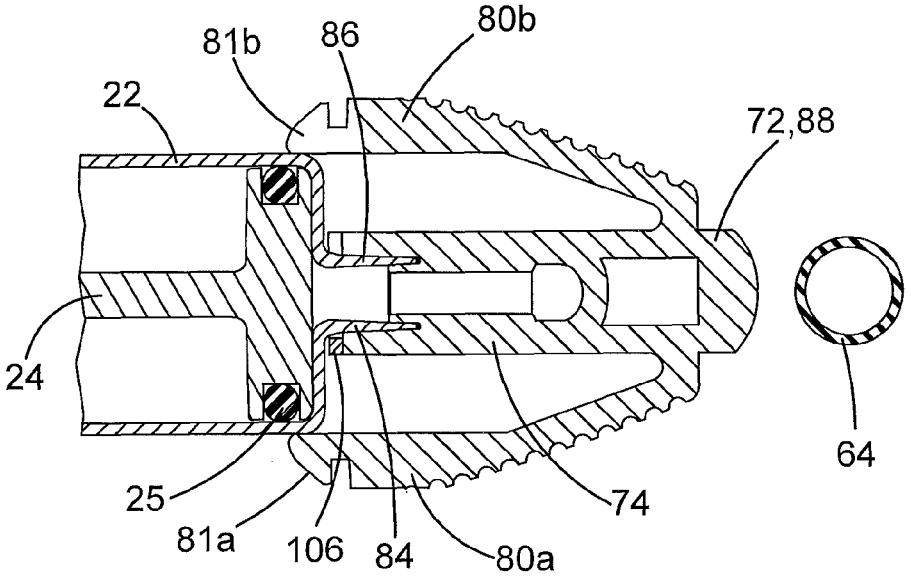
FIG. 6 shows a cross-sectional view of portions of the paint applicator and a paint reservoir along plane Y"-Y" in FIG. 2.

Referring to FIG. 6, when the receiver structure 72 of the paint applicator 18 is connected to the main body 12 and the manifold 74 is received in the paint applicator receiving cavity 78, the flexible cantilever arms 80*a*, 80*b* of the receiver structure are located far enough towards the rear of the main body that the hooks 81*a*, 81*b* of the cantilever arms overlap with the syringe 22. In this position, the cantilever arms cannot be flexed inwardly to unhook the hooks 81*a*, 81*b* from the rebates 83*a*, 83*b* in the clam shells. The paint applicator cannot be released from the main body without first removing the paint reservoir from the paint reservoir receiving bay 20. This provides another interlock arrangement which helps limit or avoid spillage of paint on parts of the main body by the plunger 24 which is normally biased toward a paint dispensing position.

The invention claimed is:

1. A hand-holdable painting apparatus comprising:

a main body with a handle, wherein the main body is arranged to removably engage with a paint applicator; and a paint reservoir receiving bay at least one of coupled to or integral with the main body, wherein the paint reservoir receiving bay is arranged to removably receive at least a portion of a paint reservoir, wherein the main body is arranged to provide a paint flow path between an outlet of a paint reservoir in the paint reservoir receiving bay and an inlet of a paint applicator engaged with the main body, and wherein the hand-holdable painting apparatus comprises:

an interlock configured to inhibit the paint reservoir receiving bay from receiving a paint reservoir unless a paint applicator is engaged with the main body.

2. A hand-holdable painting apparatus as claimed in claim 1, wherein the interlock is moved to permit the paint reservoir receiving bay to receive a paint reservoir upon engagement of a paint applicator with the main body.

3. A hand-holdable painting apparatus as claimed in claim 2, wherein the interlock is moved to permit the paint reservoir receiving bay to receive a paint reservoir by contact between the interlock and a paint applicator engaged with the main body.

4. A hand-holdable painting apparatus as claimed in claim 1, wherein the interlock is biased to inhibit the paint reservoir receiving bay from receiving a paint reservoir.

5. A hand-holdable painting apparatus as claimed in claim 1, wherein the main body has a paint applicator receiving cavity arranged to removably receive an inlet portion of a paint applicator engaged with the main body.

6. A hand-holdable painting apparatus as claimed in claim 5, wherein the paint applicator receiving cavity and the paint reservoir receiving bay are mutually aligned to fluidly couple an outlet of a paint reservoir received in the paint reservoir receiving bay with an inlet of a paint applicator engaged with the main body.

7. A hand-holdable painting apparatus as claimed in claim 5, wherein the interlock comprises a see-saw member pivotable about an interlock axis fixed in relation to the main body and wherein a first end of the see-saw member inhibits the paint reservoir receiving bay from receiving a paint reservoir unless a second opposite end of the see-saw member is contacted by a paint applicator engaged with the main body.

8. A hand-holdable painting apparatus as claimed in claim 7, wherein the second end of the see-saw member is contactable with an inlet portion of a paint applicator engaged with the main body.

9. A hand-holdable painting apparatus as claimed in claim 7, wherein the see-saw member has a substantially L-shaped cross-sectional profile configured to accommodate a portion of a paint reservoir received by the receiving bay paint reservoir.

10. A hand-holdable painting apparatus as claimed in claim 7, wherein the painting apparatus comprises a vibration mechanism for vibrating a paint pad of a paint applicator engaged with the main body.

11. A hand-holdable painting apparatus as claimed in claim 10, wherein the painting apparatus comprises a power source to energize the vibration mechanism and a switch operable to couple the power source to the vibration mechanism.

12. A hand-holdable painting apparatus as claimed in claim 10, wherein the painting apparatus comprises a paint flow control mechanism to adjustably control flow of paint from a paint reservoir received in the paint reservoir receiving bay to a paint applicator engaged with the main body.

13. A hand-holdable painting apparatus as claimed in claim 10, wherein the painting apparatus comprises a paint delivery mechanism arranged to cause flow of paint from a paint reservoir received in the paint reservoir receiving bay to a paint applicator engaged with the main body.

14. A hand-holdable painting apparatus as claimed in claim 10, wherein the painting apparatus comprises a second interlock configured to inhibit disengagement of a paint applicator from the main body while a paint reservoir is received in the paint reservoir receiving bay.

15. A hand-holdable painting apparatus as claimed in claim 10, wherein the painting apparatus is equipped with a paint reservoir removably received in the paint reservoir receiving bay and a paint applicator removably engaged with the main body.

* * * * *